United States Patent [19]

Hiendl

[11] Patent Number: 5,038,545

[45] Date of Patent: Aug. 13, 1991

[54] REINFORCING STEEL ROD WITH IMPROVED REVERSE BENDABILITY

[76] Inventor: Heribert Hiendl, Gerhart-Hauptmann-Strasse 19, 8440 Straubing, Fed. Rep. of Germany

[21] Appl. No.: 346,849

[22] Filed: May 3, 1989

[30] Foreign Application Priority Data

May 9, 1988 [DE] Fed. Rep. of Germany ..... 3816150
May 17, 1988 [DE] Fed. Rep. of Germany ..... 3816930

[51] Int. Cl.[5] ..... E04C 5/03; E04C 5/16; E04B 1/38

[52] U.S. Cl. ..... 52/738; 52/713; 52/739; 29/897.34

[58] Field of Search ..... 52/737–738, 52/295, 378, 739, 740, 250, 251, 259, 713; 29/897, 897.3, 897.34

[56] References Cited

U.S. PATENT DOCUMENTS

| | | | |
|---|---|---|---|
| 1,014,712 | 1/1912 | Lindau | 52/738 X |
| 1,635,658 | 7/1927 | Boardman | 52/740 X |
| 2,137,718 | 11/1938 | Friberg . | |
| 2,948,995 | 8/1960 | Cogan | 52/250 X |
| 3,292,337 | 12/1966 | Finsterwalder | 52/738 |
| 3,691,710 | 9/1972 | Gilbert et al. | 52/251 |
| 3,916,592 | 11/1975 | Morohashi | 52/252 |
| 4,010,586 | 3/1977 | Brechbuhler | 52/378 X |
| 4,056,911 | 11/1977 | Tani | 52/738 |
| 4,308,705 | 1/1982 | Hufnagl | 52/738 X |
| 4,329,825 | 5/1982 | Zehtner | 52/713 X |
| 4,338,757 | 7/1982 | Witschi | 52/378 X |
| 4,872,298 | 10/1989 | Klemic | 52/295 |
| 4,899,515 | 2/1990 | Potucek | 52/738 |

FOREIGN PATENT DOCUMENTS

| | | | |
|---|---|---|---|
| 636303 | 2/1962 | Canada | 52/738 |
| 98825 | 1/1984 | European Pat. Off. . | |
| 203434 | 9/1987 | European Pat. Off. . | |
| 1077854 | 3/1960 | Fed. Rep. of Germany . | |
| 1267406 | 5/1968 | Fed. Rep. of Germany . | |
| 420102 | 1/1911 | France . | |
| 1252065 | 12/1960 | France | 52/738 |
| 1358698 | 3/1964 | France . | |
| 960685 | 6/1964 | United Kingdom . | |

OTHER PUBLICATIONS

"Rissanfälligkeit quergerippter Betonstähle", Stahl u. Eissen 77, Nr. 1, 10 Jan. 1957, pp. 11–15.

*Primary Examiner*—Richard E. Chilcot, Jr.
*Assistant Examiner*—Deborah McGann Ripley
*Attorney, Agent, or Firm*—Hoffman, Wasson & Gitler

[57] ABSTRACT

A reinforcing steel for use particularly in reinforcing connections. The steel including ribbing and/or shaping along its surface to allow for bonding in concrete, but also including portions where the surface is free of ribbing and/or shaping at points where the steel is intended to be bent. This structure allows for increased load bearing capabilities where bending takes place.

10 Claims, 6 Drawing Sheets

REINFORCING STEEL ROD WITH IMPROVED REVERSE BENDABILITY

BACKGROUND OF THE INVENTION

The invention relates to a structural steel that can be bent back (i.e., especially able to be statically and dynamically stressed in the area of a bending point that has been bent back) as well as to the reinforcing connection produced by using such a reinforcing steel.

In structural engineering, structural steels are used in varied ways including use as reinforcement for a variety of concrete structural elements. These structural steels can be provided with ribbing or shaping on their surface, which can be configured in a variety of ways to achieve a sufficient bonding in the concrete.

Although all structural steels approved for concrete construction must meet the so-called "bend-back" test (i.e., from the aspect of their alloy or material structure, they must be made so that during this test the respective reinforcing steel does not harden or become brittle upon bending or bending back in such a manner that with bending back or slight stresses a break occurs afterwards), it is regarded as out of the question to use as structural steels those that have been bent and then bent back again where greater static or dynamic stress occur or can be expected.

Besides the bending of structural steels (but without bending back) quite common in construction engineering, it is often advantageous from the aspect of building construction or work cycle to use structural steels so that they are first bent in a specific area and later again bent up or bent back. A typical example of this are the so-called "reinforcing connections" which are increasingly used today, where to a first concrete structural element that is to be constructed (e.g. to a first concrete wall to be constructed) another concrete structural element (e.g., another concrete wall) is to be connected. In this case, the reinforcing steel, first bent and then bent back, or reinforcing bars, bent and then bent back, form the connecting reinforcement between the two concrete structural elements. These reinforcing connections, which make passing the connecting reinforcement through the form of the first concrete structural element constructed unnecessary, basically consist of a holding element, which can exhibit varied configuration and by which in each case the reinforcing bars, formed from a length of a reinforcing steel and provided with a corresponding ribbing or shaping, project out with a first partial length (anchoring area). With a second partial length (connecting area or part), bent substantially at right angles to the first partial length, the reinforcing bars are placed, in a covered manner, inside the holding element. Such a reinforcing connection is inserted into the concrete form for the first concrete structural element to be constructed so that the anchoring areas of the reinforcing bars are embedded in the concrete of the first concrete structural element constructed and the connection parts of the reinforcing bars are inside the holding element close to the form wall. After removal of the first constructed concrete structural element from the form and before concreting the concrete structural element to be connected, the connecting parts of the reinforcing bars are exposed and bent upward with a suitable tool, so that the connecting part, bent up or back, can be embedded in the concrete of the concrete structural element to be connected and thus form the connecting reinforcement on the transition area.

Despite bending (in making the reinforcing connection), as well as the subsequent bending up and back (in using the reinforcing connection) to achieve to some extent satisfactory results in regard to the carrying capacity of the connecting reinforcement, special heat-treated structural steels as reinforcing bars and special tools for bending the connecting parts upward have already been proposed. Nevertheless, in the case of usual structural steels, especially in bending back, microcracks in the structural steel cannot be avoided. Such microcracks decisively reduce the fatigue limit of the reinforcing steel, so that with all known structural steels, after bending and bending back, only relatively low fatigue limits on the order of 80 n/mm$^2$ can be achieved. Because of this low fatigue limit, structural steels which have been bent and bent back are often used only where special stresses in the construction are not to be expected. This described problem is particularly serious if structural steels with relatively large diameters (for example, on the order of 6–16 mm) are necessary. For example, where an effort is made to obtain as small a radius of curvature or bending on the bending and bending back area to reduce the overall height of the holding element of a reinforcing connection or for other reasons.

SUMMARY OF THE INVENTION

The object of the invention is to provide a reinforcing steel which, after bending (especially by small bending radii) and bending back, is capable of both substantially higher static and dynamic stress in comparison with known structural steels. Thus providing a reinforcing steel that can be used advantageously, especially where bending and later bending back is necessary in the work cycle. Further, the object of the invention is to provide a reinforcing connection, which has improved properties in comparison with known reinforcing connections and with which an improved fatigue limit for the reinforcing bars is achieved despite the necessary repeated bending of the reinforcing bars (especially even at small bending radius).

This object is achieved by a reinforcing steel having areas provided for bending and bending back that do not exhibit ribbing and/or shaping on one partial area of its periphery, which corresponds to at least approximately one third of the cross section periphery of the reinforcing steel or a reinforcing connection characterized by reinforcing bars, formed by lengths of reinforcing steel, wherein the anchoring areas project over an outside surface of the holding element and are adapted to be embedded in the concrete structural element as well as placed inside the holding element. The anchoring areas form connecting parts to be bent out for connection to a concrete structural element to be connected later. The connecting parts in each case connect by a bending or transition area to an anchoring area wherein in each case the bending or transition areas are made on an area of reinforcing steel provided for bending and subsequent bending back.

The reinforcing steel according to the present invention, at least in certain areas, does not exhibit the otherwise provided shaping or ribbing, or else, is provided only on a part of its periphery with a ribbing or shaping. The certain areas are successively provided where the reinforcing steel can be bent and bent back during use. This is accomplished during the production or the ribbing or the shaping of the structural steel at preferably preset intervals in the moving sense or direction of the structural steel. As a result, the reinforcing steel according to the present invention displays very decisive improvement in the fatigue limit after bending and bending back. But at the same time, the necessary bonding of the reinforcing steel in the concrete is also guaranteed.

The reinforcing steel according to the invention is suitable in a particularly advantageous way for reinforcing bars of reinforcing connections. The use of the reinforcing steel according to the invention is not limited to this special case of application, rather the reinforcing steel according to the invention can be used with the described advantages wherever a bending and then bending back of the latter stressed reinforcing steel in the work cycle is necessary or advisable.

If the bending or bending back areas are not kept completely free of the otherwise provided ribbing or shaping, but the ribbing or shaping is provided only on a part of the peripheral area of the reinforcing steel on these bending or bending back areas, the bending of the reinforcing steel takes place in such a way that, in relation to the bending, the partial area of the cross-sectional periphery not exhibiting the shaping or ribbing is on the outside.

In addition to the described design of the reinforcing steel, a special alloy for this steel contributes decisively to achieving an improved fatigue limit.

In a heat-treated steel, for example produced according to the "TEMPCORE Process", the steel is preferably made from a steel alloy, which contains 0.12 to 0.22% by weight of carbon, 0.5 to 1.0% by weight of manganese, less than 0.05% by weight of phosphorus, less than 0.05% by weight of sulfur, less than 0.6% by weight of copper, less than 0.05% by weight of tin and less than 0.018% by weight of nitrogen.

In a cold-formed or cold-rolled or cold-drawn steel, it is preferably produced from a steel alloy which contains 0.06 to 0.20% by weight of carbon, 0.35 to 0.85% by weight of manganese, less than 0.6% by weight of copper and less than 0.50% by weight of silicon, and the carbon portion preferably is 0.08 to 0.14% by weight.

In a microalloyed steel, the reinforcing steel is preferably made from a steel alloy, which contains less than 0.24% by weight of carbon, less than 1.5% by weight of manganese and less than 0.12% by weight of vanadium. Wherein the carbon portion preferably is 0.16 to 0.22% by weight, the manganese portion preferably is 0.8 to 1.2% by weight and the vanadium portion preferably is 0.03 to 0.08% by weight.

With the reinforcing steel according to the invention with small bending radius on the bent and bent back structural steel, fatigue limits (according to DIN 488) on the order of 230 $N/mm^2$, but also greater, can be achieved. In contrast, prior to the present invention, structural steels under the same conditions achieved fatigue limits on the order of about 80 $N/mm^2$ at most.

The advantages obtained with the invention are caused by keeping the bending or bending back ares free to the greatest extent possible from ribbing or shaping. Also the steel alloy used in producing the reinforcing steel leads to a sufficiently ductile steel, which contributes, on the bending or bending back areas, to the tendency to reduce substantially fissuring in the structuring steel in a bending and then bending back.

BRIEF DESCRIPTION OF THE DRAWINGS

Preferred further developments of the invention are the object of the subclaims. The invention and its advantages are explained in greater detail below by the figures in connection with the reinforcing connections, since the use of the reinforcing steel according to the invention in reinforcing connections represents the preferred one of numerous conceivable possible uses. There are shown in:

DESCRIPTION OF THE PREFERRED EMBODIMENT

Figure 1:
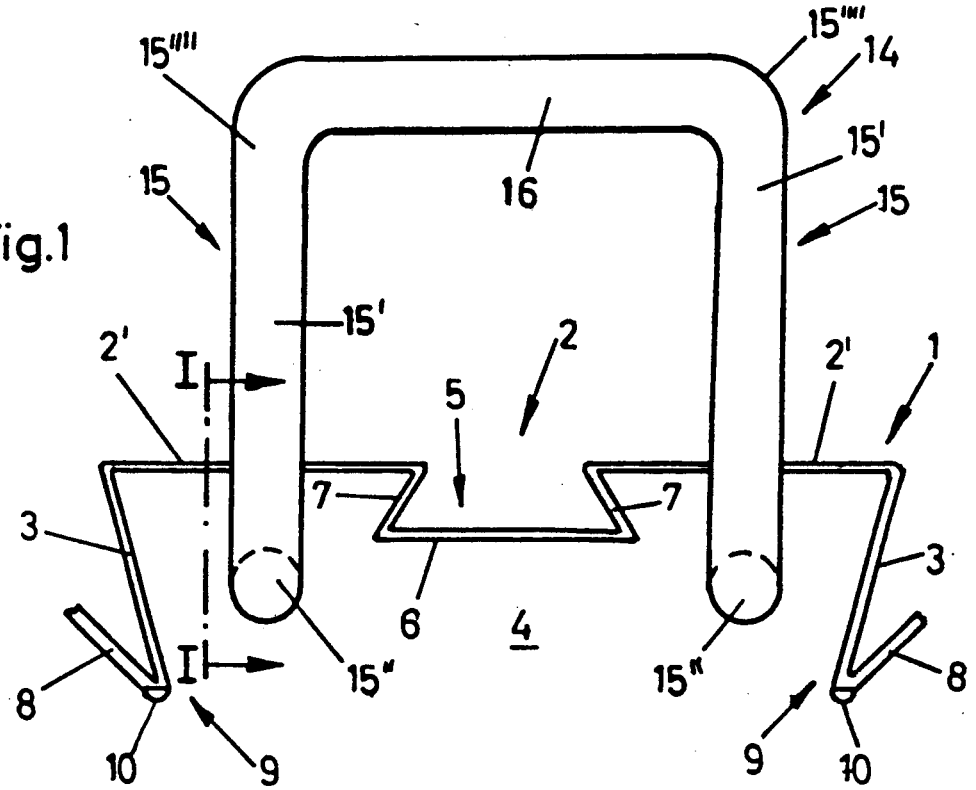
FIG. 1 is a cross section of a reinforcing connection used for insertion into a form for a concrete structural element, in which the reinforcing connection has reinforcing bars that are produced from a length of a reinforcing steel according to the invention by bending.

The reinforcing connection, represented in the figures, consists of a box-shaped or profile-shaped holding element 1, which is produced from sheet steel by bending. Holding element 1 substantially consists of a bottom 2 and two legs 3 constructed from one piece by way bending. Bottom 2, as well as legs 3, extend over the entire length of holding element 1, running perpendicular to the drawing plane of figure and enclose inside space 4 of the holding element 1 which is closed by two ends of the holding element by a removable sealing element (not shown). The removable sealing element may be made of foamed plastic (not shown) or may be a cover on the open side opposite the bottom 2. A longitudinal groove 5, extending over the entire length of holding element 1, and therefore perpendicular to the drawing plane of FIG. 1, is formed in the center of bottom 2. The groove 5 is so designed in the embodiment represented that bottom 2 in the area of this longitudinal groove extends into inside space 4. Longitudinal groove 5 divides bottom 2 into two bottom areas 2', one of which is provided respectively on each side of the longitudinal groove 5 and changes into a corresponding leg 3. Leg 3 and adjacent bottom area 2' form an acute angle so that the holding element exhibits a dovetailed cross section formed by legs 3. Bottom 6 of longitudinal groove 5 is parallel to bottom sections 2' and, by way of leg areas 7, is connected to bottom sections 2'. Each leg area 7 forms an acute angle with the surface of bottom 6 turned away from the open side of holding element 1 as well as with the surface of the adjacent bottom area 2' turned toward the open side of holding element 1. Consequently, in the cross section plane running perpendicular to the longitudinal extension of the holding element 1, longitudinal groove 5 and the bottom areas 2' between leg areas 7 and legs 3 exhibit dovetail cross sections.

Each leg 3, on its free longitudinal edge located away from bottom 2 and extending over the entire light of holding element 1, changes into a bend 8, which projects over the outside surface of relevant leg 3 and encloses an acute angle with this outside surface. The two bends 8 serve first for reinforcing holding element 1 or legs 3 on their free longitudinal edges located away from bottom 2. But especially by bends 8 a reinforced resting surface is achieved, with which holding element 1 rests against the inside surface of the concrete form of the first concrete structural element to be constructed. This resting surface is formed by transition area 9 between the respective leg 3 and related bend 8. At least on this transition area 9, i.e., on the surface, which is outside the acute angle formed by leg 3 and bend 8, there is provided on the free longitudinal edge of each leg 3 a coating 10 with a material, which swells in the moist state and thus causes a sealing effect as will be further described below. This coating consists, for example, of clay or bentonite with a suitable binder and may be applied in the form of a paint. The usual binders used in paints, for example, are suitable as binders as it applies to the present invention. To improve bonding of holding element 1 in the concrete structural element to be constructed first (for example, in concrete wall 11) as well as to improve bonding of holding element 1 in the concrete structural element to be later constructed or connected (e.g., concrete wall 12) holding element 1 is provided at least on bottom 2 or on bottom areas 2' with a coating 13, which gives a particularly rough surface to holding element 1 in this area of the coating. This coating may be applied on the inside surface (turned toward inside space 4) or outside surface (turned away from inside space 4) of bottom 2 or bottom areas 2' and results in improved shear stress or shear force transmission to the connection point between the two concrete structural elements or concrete walls 11 and 12. In the simplest case, coating 13 can be made of sand, which is held on the respective surfaces of holding element 1 with a suitable adhesive or plastic. Preferably however, coating 13 consists of cement clinker, which enters into a close bonding in the concrete of the respective concrete structural element and in the same way is held on the respective surface of the holding element by a suitable adhesive or plastic. Other types of coating 13 are also possible, provided they cause a roughened surface for holding element 1. Moreover, coating 13 may, of course, be provided additionally on other areas. For example, the area of longitudinal groove 5 and/or in the area of legs 3.

Further, the represented reinforcing connection has several reinforcing bars 14, which are bent U-shaped or as stirrups and thus in each case exhibit two legs 15 and a yoke section 16 connecting these legs together. Reinforcing bars 14, are positioned with their yoke sections 16 perpendicular to the longitudinal extension of holding element 1. Legs 15 are put through openings provided in bottom areas 2' so that in each case a leg 15 exhibits a corresponding passage point (through bottom area 2') on left bottom area 2' in FIG. 1 and the other leg 15 exhibits the corresponding passage point on right bottcm area 2' in FIG. 1. Legs 15 preferably are bonded to bottom areas 2' by welding or other suitable means at the passage points.

Each leg 15 consists of a first section 15', which is directly connected to yoke section 16 and projects perpendicularly from the outside surface to bottom 2 (i.e., turned away from inside space 4). Together, corresponding sections 15', of the legs 15 and yoke section 16, form the anchoring area of respective reinforcing bar 14. A second section 15'' of each leg 15 is bent at 15''' (transition area) approximately perpendicular to section 15' and is placed directly on the inside surface of the respective bottom area 2' (i.e., in inside space 4 of holding element 1). Sections 15'' form the connecting parts—to be bent out later—of reinforcing bars 14 or of the reinforcing connection. Reinforcing bars 14 have a cross section, which for example is on the order of 6-16 mm, corresponding to the respective static and/or dynamic requirements.

Figure 3:
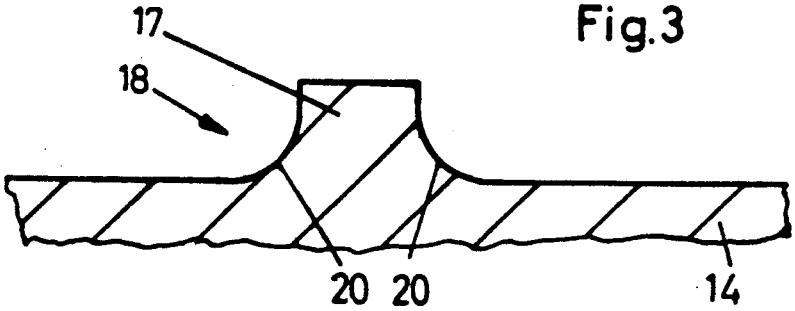
FIG. 3 is an enlarged representation of the profile of the ribs of the reinforcing bars according to FIG. 1.

To improve the bonding or anchoring of reinforcing bars 14 in the concrete of concrete walls 11 and 12, each reinforcing bar 14 is provided on its surface or peripheral area with a multiplicity of ribs 17 running obliquely to the longitudinal extension of the reinforcing bar and projecting over the surface, in a manner common within the art of reinforcing bars or structural steels. These ribs 17, produced in rolling, exhibit the profile represented in FIG. 3. But in accordance with the principles of the present invention, to improve the properties of the reinforcing element or reinforcing connection, reinforcing bars 14 do not exhibit such ribs 17 on transition areas 15''', as will be explained in detail below.

Since bent sections 15'' of all reinforcing bars 14 are housed in inside space 4 of holding element 1, its overall height (i.e., the distance which bottom areas 2' exhibit from the free edges of legs 3 in the direction perpendicular to their surface sides) is determined by the diameter of reinforcing bars 14 as well as by the radius of curvature r on transition area 15''' located between section 15' and bent section 15'' of each leg 15. Especially in an attempt to save materials, to reduce shipping volume, for static aspects, etc., a low overall height for holding element 1 is sought. That is, as small as possible radius of curvature r in the bending area between sections 15' and 15'' is sought. However, it is necessary not to go below the lower boundary value for bending radius r, since otherwise both the bending of sections 15'' occurring in the making of the reinforcing connection and also the bending up of sections 15'' taking place with the use of the reinforcing connection as described below results in a cold forming of the steel of reinforcing bars 14 and especially the occurrence of microcracks in reinforcing bars 14. Such results adversely affect the strength, especially the fatigue limit of reinforcing bars 14.

Figure 4:
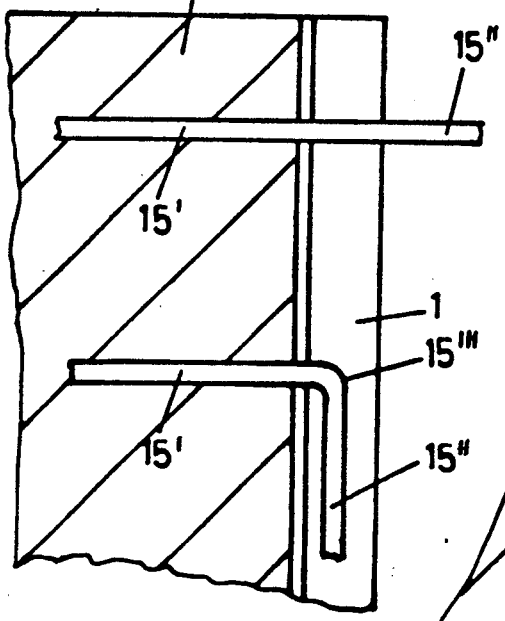
FIG. 4 is a diagrammatic representation of a partial length of the reinforcing connection embedded in the first constructed concrete structural element, with a bent up connecting part as well as with a connecting part not yet bent up.
Figure 5:
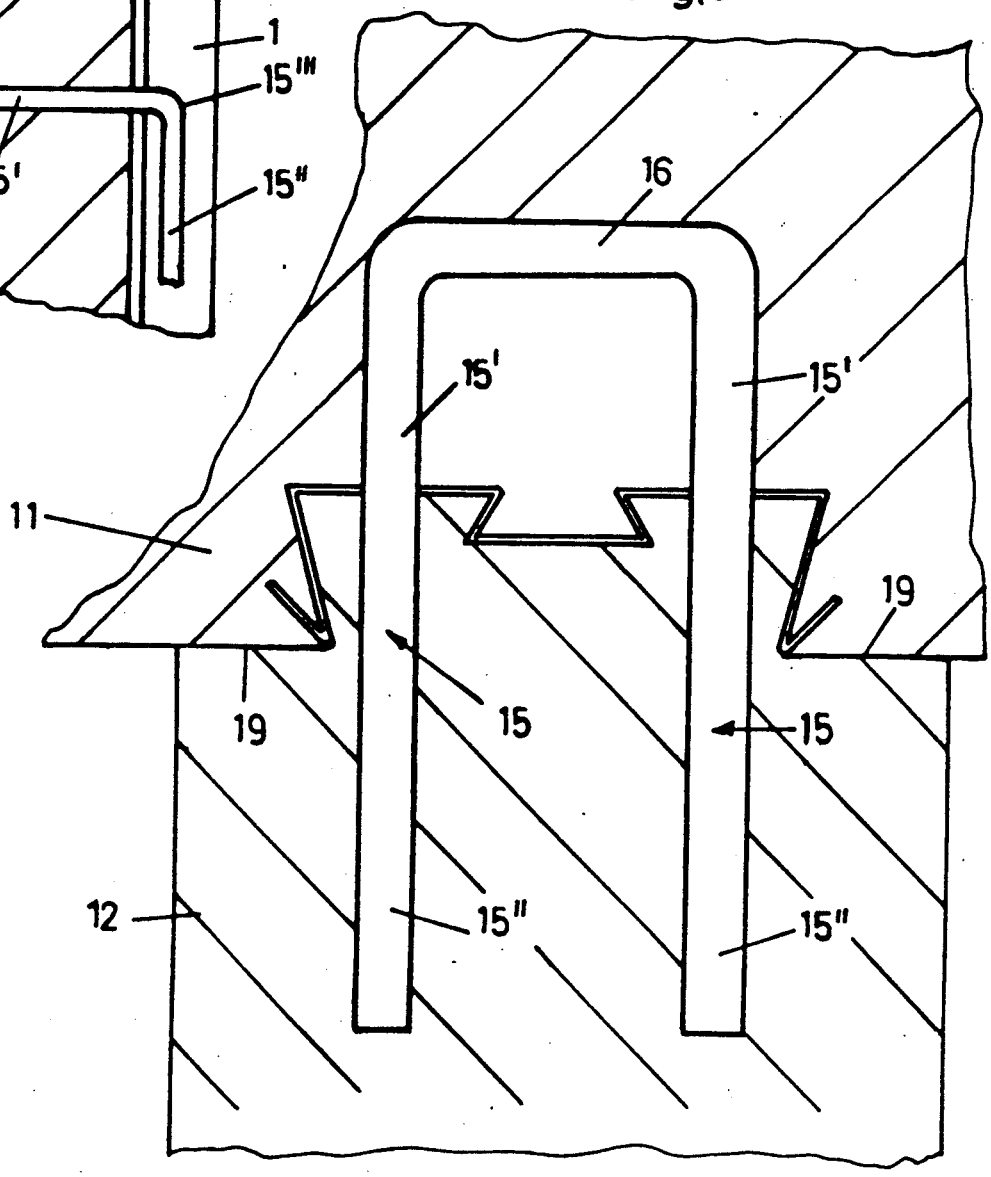
FIG. 5 is a diagrammatic representation of a horizontal cross section through two concrete structural elements and the reinforcing connection forming the transition area of these concrete structural elements.

The basic use of the reinforcing connection is seen in FIGS. 4 and 5. In making the first concrete structural element to be constructed (for example, concrete wall 11) before introduction of the concrete, the reinforcing connection is placed in the form that is used so that holding element 1 with its open side (i.e., in the area of transitions 9) rests against the inside surface of a form wall of the form used. As such, the placement of the concrete of concrete wall inside space 4 of holding element 1 is kept free from the concrete introduced into the form, because it is delimited by holding element 1 and the form wall. This is achieved primarily by the cooperation of the above-mentioned closing elements and the two ends of holding element 1 as well as the cover. After placing the concrete of concrete wall 11, anchoring areas 15'/16 of reinforcing bars 14 as well as bendings 8 are embedded in the concrete.

After removal of the form of concrete wall 11, the cover, formed in the simplest case from a plastic sheet, is removed. It should be noted that the cover is also used as a covering for coatings 10. Then exposed sections 15'' are bent up by bending back of the respective transition areas 15''' so that each section 15'' is equiaxial as much as possible with section 15' of the respective leg 15. This bending may be accomplished with the help of a suitable bending tool corresponding to Arrow A of FIG. 4.

The passage points of reinforcing bars 14, or their legs 15, through bottom 2 of holding element 1 are in areas 2'. In comparison with the total bottom 2, bottom areas 2' exhibit a reduced width. This is a result of the connection of a leg 3 and a leg area 7 being connected to each of the bottom areas 2'. As a result of this configuration, in bending up of sections 15'', even with the use of thin sheet metal for holding element 1, it is guaranteed that the sheet metal of the holding element 1 in bottom areas 2' is so solidly anchored in the concrete of concrete wall 11 by the dovetail cross section (formed therein by a leg section 7 and a leg 3) that in bending up the sheet metal is not lifted in any area from the concrete of concrete wall 11. Thus, the bonding of holding element 1 by coating 13 in concrete wall Il is not lost. In addition, coating 13 cannot come loose at any point from holding element 1 or peel off from the surface of the holding element turned toward inside space 4. By the described configuration of bottom 2 (i.e., by longitudinal groove 5 provided in bottom 2) an optimal effectiveness of coatings 13 is achieved and thus an optimal transmission of shear force between concrete walls 11 and 12 in the connection area is assured.

After completion of concrete wall 12, sections 15'' of reinforcing bars 14 are also embedded in this concrete wall, so that the acting tensions can be transmitted by the connecting reinforcement formed by reinforcing bars 14, between concrete walls 11 and 12. As FIG. 5 shows, the holding element is also completely embedded in the concrete after completion of concrete wall 12. Moisture possibly penetrating into joints 19 between concrete walls 11 and 12 leads to a swelling of coating 10 and thus to a sealing of these joints. In the embodiment represented in FIGS. 1-5, ribs 17 of reinforcing bars 14 are designed so that these ribs 17 form an angle a with the longitudinal extension of the respective reinforcing bar 14. Angle a is smaller than 45~, and is preferably in the range between 30 and 45~.

Reinforcing bars 14 can be produced as microalloyed, heat-treated or cold-formed steels.

In the production as microalloyed steel, the reinforcing bars are made from a steel alloy, which contains less than 0.24% by weight of carbon, less than 1.5% by weight of manganese, and the portion of vanadium is less than 0.12% by weight. The preferably composition being 0.16–0.22% by weight carbon, 0.8–1.2% by weight manganese, and 0.03–0.08% by weight vanadium.

The use of a heat-treated steel, which is cooled after rolling so that it has a "soft core", guarantees a high bend-back capability, as well as a "hard" outside area or a hard "shell". The area or the shell is mainly responsible for the strength sought. The reinforcing bars produced as heat treated steel are made from a steel alloy which contains 0.12–0.22% by weight of carbon, 0.5–1.0% by weight of manganese, less than 0.05% by weight of phosphorus, less than 0.05% by weight of sulfur, less than 0.6% by weight of copper, less than 0.05% by weight of tin, and less than 0.018% by weight of nitrogen.

With the use of a cold-formed steel, reinforcing bars 14 are made from a steel alloy which contains 0.06%–0.20.% by weight of carbon, preferably 0.08–0.114% by weight of carbon, 0.35–0.85% by weight of manganese, less than 0.6% by weight of copper, and less than 0.5% by weight of silicon.

As was mentioned above, no ribs 17 are provided on the transition areas 15''' of reinforcing bars 14. This lack of ribs, in combination with reinforcing bars 14 which are already highly ductile as a result of the respective steel alloys, results in a reduced tendency in the formation of cracks in bending of reinforcing bars 14 or of reinforcing steel 14' used for these reinforcing bars 14 in making the reinforcing connection. This reduction is also produced in bending back or bending up of sections 15'' when forming the connecting parts. Because of this reduction in the formation of cracks, the carrying capacity or the fatigue limit is essentially improved in static and dynamic stressing of reinforcing bars 14, bent back or bent up, in comparison with known reinforcing connections.

Figure 6:
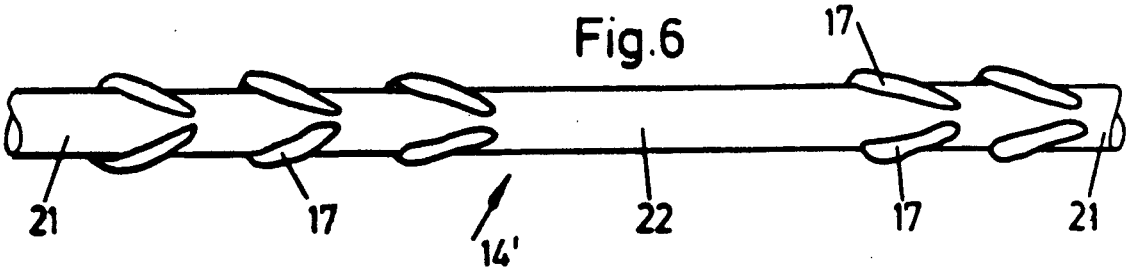
FIG. 6 shows a length of reinforcing steel from which the reinforcing bars of the reinforcing connection are produced by cutting the partial lengths and subsequent bending.

FIG. 6 shows a length of structural steel 14' as it is used for making reinforcing bars 14. This reinforcing steel 14' is made so that in the longitudinal or running direction it exhibits areas 21, on which ribs 17 in a dense sequence are provided to achieve the necessary bonding of reinforcing bars 14 in concrete. The need for ribs 17 is especially useful in securing sections 15'' in the concrete (even with relatively short lengths for sections 15'''). In each case such an area 21 is followed by an area 22, which is kept free of ribs 17. With the produced reinforcing connection, the bending and transition areas 15''' are formed, in each case, in an area 22.

For production of structural steel 14', tools or rolls are used which exhibit on their working or forming surface at least two sections merging into one another or contacting one another. One section has recesses corresponding to ribs 17 for forming them and thus forms the area 21 provided with ribs 17, while the respective other section of each mold does not have these recesses forming ribs 17 and thus forms areas 22 of structural steel 14'.

With the use of a cold-formed steel or reinforcing steel 14' for reinforcing bars 14, an additional advantage is that the molds used in regard to their forming or working surfaces can be produced in an especially simple way and with long service life. Namely, they may be produced by making the recesses producing ribs 17 by spark erosion in the respective section of the forming or working area used for forming areas 21.

For the production of the reinforcing connection, reinforcing steel 14' is unwound (e.g., from a winding or coil) and then a preset partial length is cut off from the front end in the unwinding direction, which is then bent into a reinforcing bar 14. In this case, it is advisable that the length of areas 21 provided with ribs 17 and the cutting of the partial lengths for the formation of reinforcing bars 14 from reinforcing steel 14' be one selected in such a manner that bending these partial lengths into individual reinforcing bars 14 takes place so that not only the bending or transition areas 15''' between sections 15' and 15'', but also the bending and transition areas 15'''' between each section 15' and 16, are formed in an area 22 without ribs 17.

Of course, it is also possible for the lengths of areas 21 and 22 of reinforcing steel 14' to be selected so that after production of reinforcing bars 14 several areas 22 alternating with areas 21 are exhibited on sections 15'', 15' and/or 16. However, regardless of this selection, bending or transition areas 15''' are formed from areas 22.

With the symmetrical configuration of the stirruplike bent reinforcing bars 14, the separation of the partial lengths from reinforcing steel 14' may occur in the center of either an area 21 or an area 22. Each separated partial length exhibits at least two areas 22 at a distance from each other, which largely corresponds to the sum of the lengths of the two sections 15' as well as a section 16.

Figure 7:
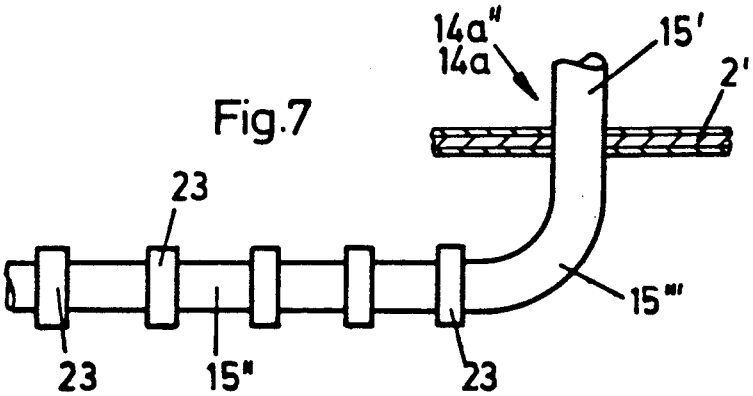
FIGS. 7 to 9 show various embodiments of the reinforcing connection illustrated in FIG. 2, where different structural steels are used for the reinforcing bars.

In the embodiment reproduced in FIG. 7, reinforcing bars **14*a*, corresponding in their form to reinforcing bars 14, are produced by bending from a reinforcing steel. The reinforcing steel is produced from one of the alloys described above, but has no ribs 17 on its surface. In the case of relatively short length of sections 15'' forming the connecting parts to be bent out later, several rings 23 forming a rib like projection in each case are fastened thereto to achieve a satisfactory bonding of these sections in the concrete. These rings are either clamping rings or clamping sleeves (i.e., rings or sleeves) which are held on sections 15'' by force fit. Alternatively, rings 23 or the corresponding sleeves, after sliding onto the respective section 15''**, may be held there by welding or in any other suitable manner.

Figure 8:
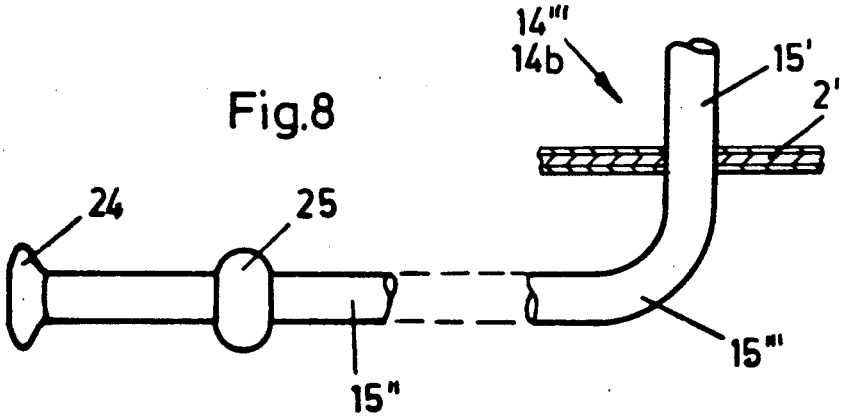

FIG. 8 shows an embodiment, in which reinforcing bars **14*b*, corresponding in turn in their shape to reinforcing bars 14, are produced from a reinforcing steel of one of the above-mentioned alloys, which (the reinforcing steel) also does not exhibit ribs 17. To achieve the necessary bonding of sections 15'' in the concrete, the material forming reinforcing bars 14*b* is upset on the free ends of sections 15'' so that a thickened head 24 is produced on these ends. In this embodiment, it is also possible to upset the material forming reinforcing bars 14*b* several times between the free ends of these sections and the respective bending and transition area 15''' so that, in addition to head 24, ring-shaped or rib-shaped projections 25** are also produced.

As a result of rib-free transition areas 15''', the tendency for the formation of cracks in bending of sections 15'' (in the production of the reinforcing connection) as well as in bending back these sections (in later use) is substantially reduced. This reduction is especially enhanced when rib-free transition areas 15''' are found in combination with said alloys of the steel used for the production of reinforcing bars 14. By said measures the static and dynamic strength (fatigue limit) of bent-back reinforcing steel 14 is substantially increased, and also at the same time especially small radii of curvature r for bending transition area 15''' between sections 15' and 15'' are possible. Namely, bending radii r on the order of between twice and six times the diameter of reinforcing bars 14 used are possible. With the described measures, fatigue limits of 230 $N/mm^2$ and greater can be achieved with the bent-back reinforcing bars. With the reinforcing connection made by using the reinforcing steel according to the invention (also considering the necessary additional safety) the bent-up reinforcing bars can be stressed with a fatigue limit of at least 180 $N/mm^2$, while with all the reinforcing connections available on the market up to now the maximal admissible fatigue limit is only about 60 $mm^2$.

FIGS. 9–12 described below relate to other embodiments of a reinforcing connection produced by using the reinforcing steel according to the invention. These embodiments also exhibit the advantages described above relative to the increased fatigue limit.

Figure 2:
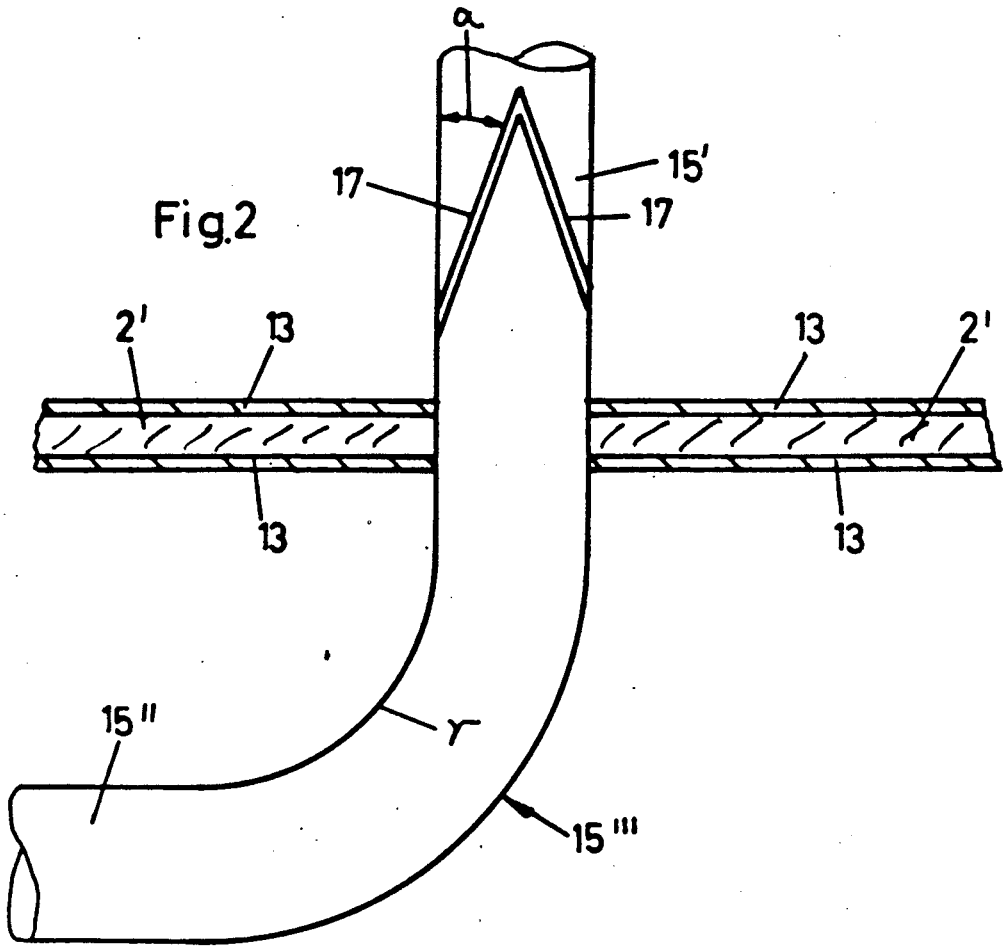
FIG. 2 is an enlarged illustration of a partial section corresponding to line I—I of FIG. 1.
Figure 10:
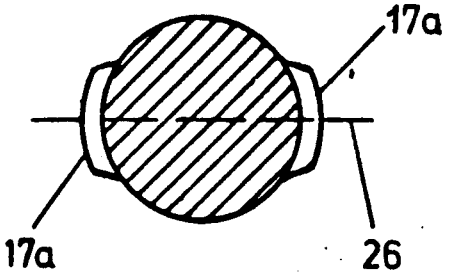
FIG. 10 is a section view corresponding to line II—II of FIG. 9.
Figure 9:
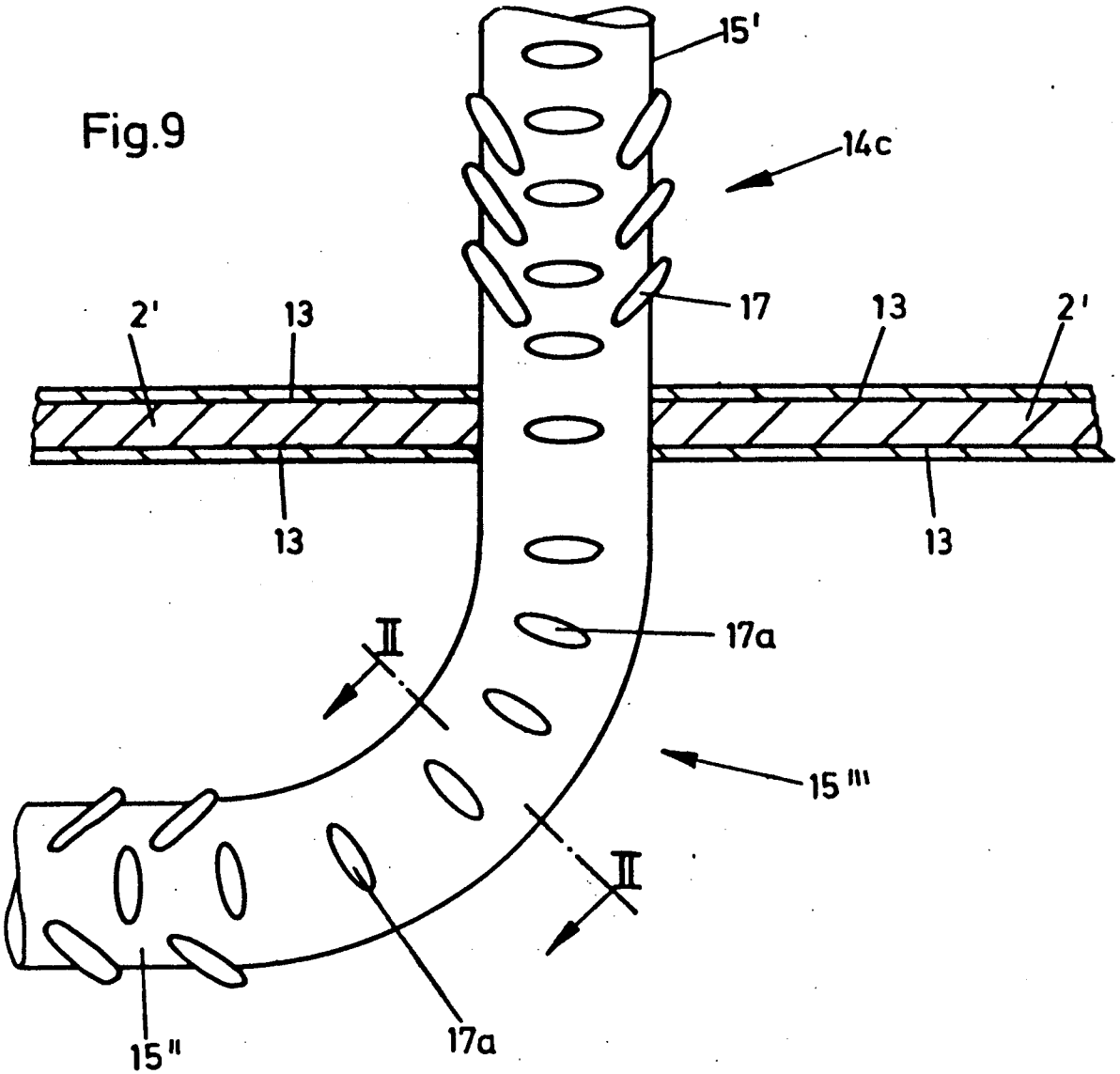

In the embodiment shown in FIG. 9 and 10, the reinforcing bars, identified there by **14*c*, exhibit, at least in the transition or bending back areas 15''', a flat or oval cross section and are bent around an axis running parallel to larger cross section axis 26. Otherwise reinforcing bars 14*c* are also provided with ribs 17 as illustrated in FIG. 2 or 6 or with other ribbing or shaping usual or usable with reinforcing bars. This ribbing or shaping is interrupted on transition areas 15''' and optionally on transition areas 15''''. Deviating from this embodiment, it is also possible for reinforcing bars 14*c* on transition areas 15''' to be made so that they exhibit ribs 17*a*, or a corresponding shaping, only where cross-sectional axis 26 intersects the peripheral surface of the respective reinforcing bar 14*c***, while the remaining part of the peripheral surface is kept free of a ribbing or shaping.

Figure 12:
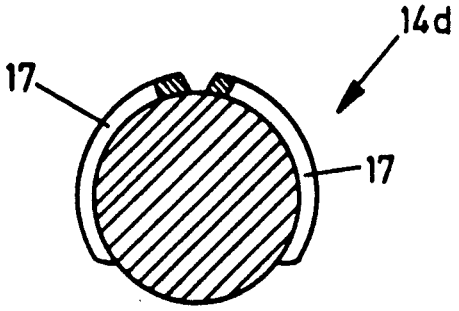
FIG. 12 illustrates a section corresponding to line III—III of FIG. 11.
Figure 11:
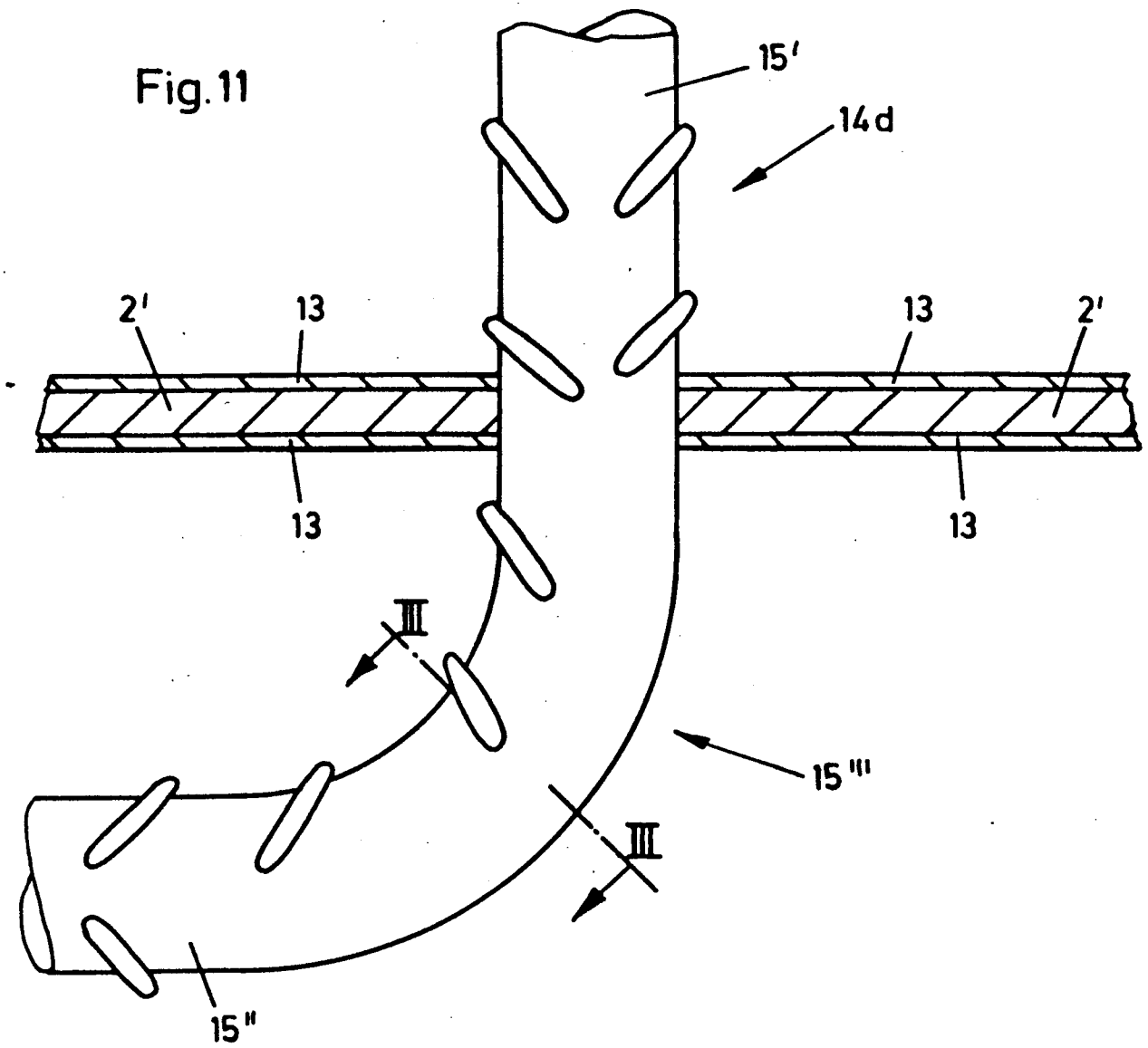
FIG. 11 illustrates another embodiment of the reinforcing connection shown in FIGS. 2 to 10, according to the invention.

Finally, FIG. 11 and 12 show an embodiment, in which reinforcing bars **14*d* include ribs 17. A total of three rows of ribs 17 running in the longitudinal direction of the respective reinforcing bar 14*d* and offset by 120° are provided on the periphery of reinforcing bar 14*d*. At least on transition areas 15''', ribs 17 of the lower rib row shown in FIG. 11 and 12 are interrupted so that there reinforcing bars 14*d* have a substantially smooth peripheral surface on the outside with regard to the bending of reinforcing bar 14*d***.

In the embodiment according to FIG. 11 and 12 it is, of course, also possible for the respective reinforcing bar **14*d* to exhibit a number of rib rows deviating from the number of three. Thus, for example, it is possible for ribs 17 to be placed in two rib rows, and also in these embodiments, at least on transition areas 15''', for ribs 17** to be omitted on the rib row or rib rows, which is/are on the outside relative to the bend there.

Figure 13:
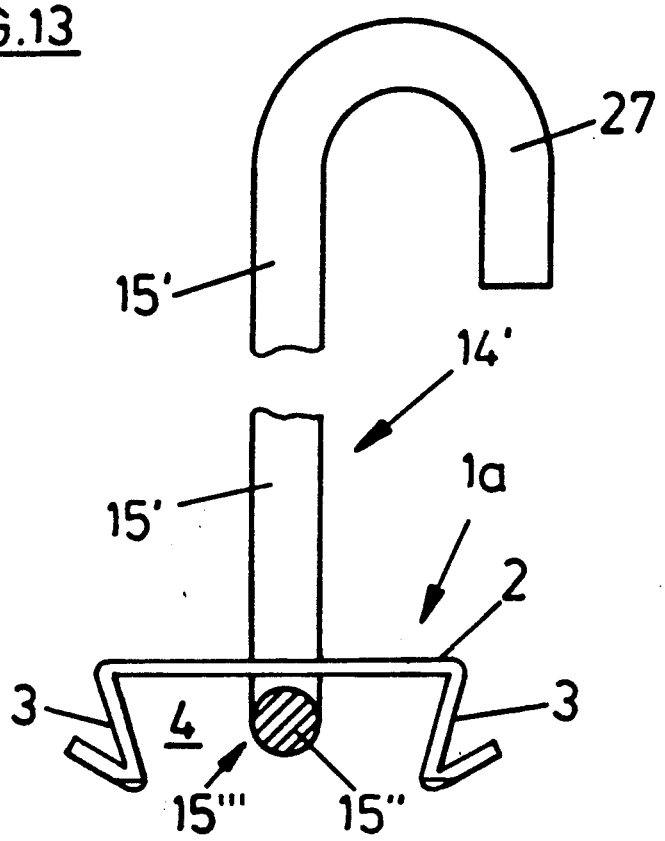
FIG. 13 illustrates another embodiment of the reinforcing connection as shown in FIG. 1.

FIG. 13 shows a reinforcing connection, which differs from the reinforcing connection according to FIG. 1, inter alia, by the fact that holding element la has a narrower width in comparison with holding element 1. Reinforcing bars **14*e* are not made stirrup-shaped but are formed from a bent length of reinforcing steel with a section 15', a section 15'', and a transition area 15'''. The reinforcing steel used for the production of reinforcing bars 15*e* exhibits the areas provided for transition areas 15''' (for example, areas 22 at uniformly recurring distances). The reinforcing connection or its reinforcing bars 14*e* can be made in a particularly simple and efficient way even with different length of sections 15' and thus match different wall thicknesses of concrete structural elements 11. In each case corresponding lengths of reinforcing steel are cut off, which between their ends exhibit at least one area (e.g. area 22) provided for transition area 15''', and then by corresponding bending of ends 27 sections 15'** can be adjusted continuously to the desired length.

In the reinforcing connection represented in FIG. 1 an adjustment of the length which sections 15' project over the outside of holding element 1 is also possible. Such adjustment is possible if the reinforcing steel used exhibits, in relative dense sequence, the areas (for example, areas 22) suitable for transition areas 15'''. For example, if a greater length for sections 15' is desired, areas 22 located farther away from one another are used as transition areas 15''', and if shorter lengths of sections 15' are desired areas 22 less farther apart are used.

Figure 14:
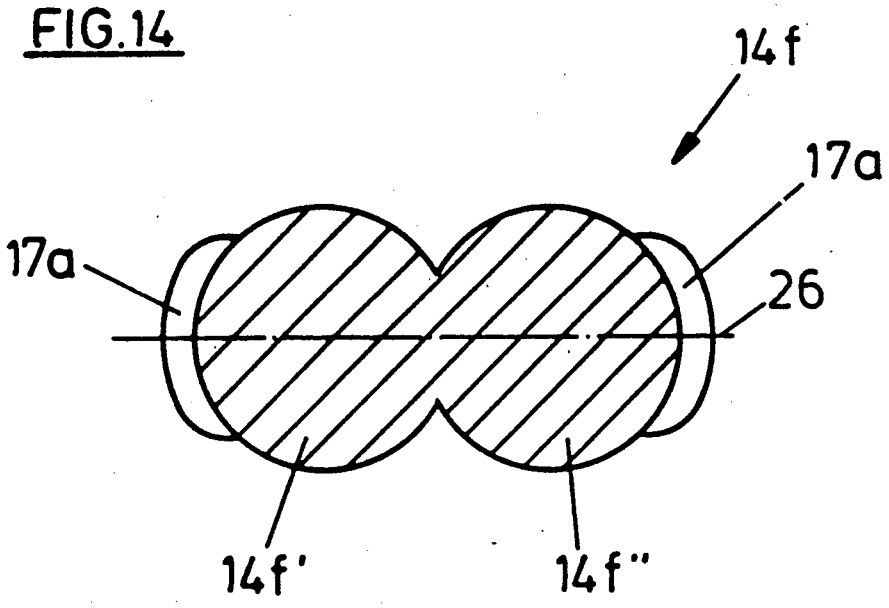
FIG. 14 illustrates a further embodiment of the reinforcing section connection as shown in FIG. 1.

FIG. 14 shows, like FIG. 10, a cross section through reinforcing bar **14*f* which consists of two substantially circular cross sections 14*f'* and 14*f''* merging into one another. Axis 26 corresponding to the larger cross section dimension in this embodiment is parallel to the bending axis in transition areas 15'''. Further, reinforcing bar 14*f* in the area of axis 26 exhibits shaping 17*a*, while otherwise a shaping or ribbing is lacking at least on transition areas 15'''. Despite a relatively large overall cross section, reinforcing bar 14*f*** can easily be bent back.

With all described embodiments it is possible to compensate for the lacking or reduced ribbing or shaping, especially on transition areas 15''', by raising the ribbing or deepening the shaping on the remaining areas of reinforcing bars 14, **14*a*–14*f*. Further, with all the described embodiments it is also possible for the reinforcing steel to exhibit a cross section, which has cross section dimensions of different size in two axial directions running perpendicular to one another. The larger cross section dimension or axis then corresponds to axis 26 of FIG. 10 and runs parallel to the bending axis of transition areas 15''', so that the smaller cross section axis is perpendicular to this bending axis. Such a cross section, for example, would be an oval or rectangular cross section. The cross section design has the advantage that despite a relatively large effective cross section, an easy bending back of reinforcing bars 14, 14*a*–14*f*** is possible.

I claim:

1. Reinforcing steel able to be statically and dynamically stressed in an area of a bending point that has been bent back comprising, ribbing or shaping on the surface of said reinforcing steel, wherein said reinforcing steel, on said areas provided for a bending and subsequent bending back, is free of said ribbing or shaping at least on one partial area of its periphery, wherein said partial area corresponds to at least approximately one third of the cross section periphery of reinforcing steel.

2. Reinforcing steel according to claim 1, wherein said reinforcing steel exhibits, at least on the bending or bending back areas, a cross section with two cross section axes of different size.

3. Reinforcing steel according to claim 1, wherein said bending and bending back areas of said reinforcing steel are completely free of ribbing or shaping.

4. Reinforcing steel according to claim 1, wherein said reinforcing steel exhibiting, at least on said bending or bending back areas, an oval cross section having a larger cross section axis and a smaller cross section axis, wherein said reinforcing steel includes ribbing where said larger cross section axis intersects the periphery of said reinforcing steel.

5. Reinforcing steel according to claim 2 wherein said reinforcing steel is a heat-treated steel and is made from a steel alloy which contains 0.12–0.22% by weight of carbon, 0.5–1.0% by weight of manganese, less than 0.05% by weight of phosphorus, less than 0.05% by weight of sulfur, less than 0.6% by weight of copper, less than 0.05% by weight of tin and less than 0.018% of nitrogen.

6. Reinforcing steel according to claim 1, wherein said reinforcing steel is a cold-formed steel and is made from a steel alloy which contains 0.06–0.20% by weight of carbon, 0.35–0.85% by weight of manganese, less than 0.6% by weight of copper and less than 0.5% by weight of silicon.

7. Reinforcing steel according to claim 1, wherein said reinforcing steel is a microalloyed steel and is made from a steel alloy which contains less than 0.24% by weight of carbon, less than 1.5% by weight of manganese, and less than 0.12% by weight of vanadium.

8. Reinforcing steel according to claim 1, wherein said ribbing or shaping, includes ribs, rings, or sleeves, which are fastened to said reinforcing steel.

9. Reinforcing steel according to claim 1, wherein said ribbing or shaping is produced when said reinforcing steel is so deformed by upsetting that heads or projections projecting over the peripheral surface of reinforcing steel are produced.

10. A reinforcing connection used for a concrete structural element, produced by use of a reinforcing steel according to claim 1, comprising reinforcing bars formed from lengths of said reinforcing steel, said reinforcing bars including anchoring areas projecting over an outside surface of a holding element which are to be embedded in the concrete structural element as well as placed inside said holding element, said reinforcing bars also including form connecting parts to be bent out for connection to a concrete structural element to be connected later, the connecting parts in each case are connected by a transition area to said anchoring area, and said transition areas are on said area of reinforcing steel provided for a bending and subsequent bending back.

* * * * *